US005282447A

United States Patent [19]

Kubota

[11] Patent Number: 5,282,447

[45] Date of Patent: Feb. 1, 1994

[54] DEVICE FOR STOPPING A DIESEL ENGINE

[75] Inventor: Yousuke Kubota, Tokyo, Japan

[73] Assignee: Fuji Jukogyo Kabushiki Kaisha, Tokyo, Japan

[21] Appl. No.: 991,090

[22] Filed: Dec. 15, 1992

[30] Foreign Application Priority Data

Dec. 26, 1991 [JP] Japan ..... 3-107558

[51] Int. Cl.[5] ..... F02B 77/00

[52] U.S. Cl. ..... 123/198 DB; 123/DIG. 11

[58] Field of Search .... 123/198 D, 198 DB, DIG. 11

[56] References Cited

U.S. PATENT DOCUMENTS 4,452,196 6/1984 Indra ..... 123/198 DB 5,062,400 11/1991 Minegishi ..... 123/DIG. 11

FOREIGN PATENT DOCUMENTS 2220230 1/1990 United Kingdom .

*Primary Examiner*—Noah P. Kamen

*Attorney, Agent, or Firm*—Beveridge, DeGrandi, Weilacher & Young

[57] ABSTRACT

A device for stopping a diesel engine can properly control an engine stopping operation even if an engine rotation signal is not transmitted due to disconnection of a signal line at the time of the engine stopping operation and can prevent an engine stopping actuator from being burnt even if the engine does not stop due to mechanical trouble in a stopping mechanism. A contact 1a of a key switch 1 is turned from an ON terminal to an OFF terminal, whereby a transistor TR3 of a engine stopping operation section 8 us turned off. A transistor TR4 is turned on by a discharge of a capacitor C4, and a transistor TR5 and a relay switch 10 to follow are turned on to actuate a solenoid 11 to shut off fuel supply through a stopping mechanism. If a signal is not input into an engine rotation detection section 6, or, if the engine does not stop due to mechanical trouble in the stopping mechanism, the transistor TR4 is automatically turned off with expiration of a setting time defined by the capacitor C4, and the solenoid 11 returns to an initial state.

6 Claims, 3 Drawing Sheets

DEVICE FOR STOPPING A DIESEL ENGINE

BACKGROUND OF THE INVENTION

1. Field of the Invention

The present invention relates to a device for stopping a diesel engine, particularly to a compulsory stopping apparatus of the engine by shutting off fuel body or air supply.

2. Description of the Related Art

Conventional method for stopping the diesel engine is to compulsorily limit the fuel supply or the intake air supply by closing an intake valve disposed in an intake air system.

The applicant has proposed a device for stopping a diesel engine in which, by an engine stopping signal outputted when a key switch is turned off, engine rotation is detected and an engine stopping actuator is driven, in Japanese Utility Model Publication No. 3-17160 and in Japanese Utility Model Publication No. 3-83341.

In the stopping device as described in the former publication, while a drive signal is kept outputted to the engine stopping actuator, the detection of the key switch is invalidated to prevent the engine from restarting by an erroneous operation of the key switch before the engine stops completely. In the stopping device as described in the latter publication, when a predetermined time lapses after the key switch is turned off, the rotation detection is stopped to prevent a solenoid from being burnt out by an electric current exceeding the maximum rating even if the engine does not automatically stop while failing to cut off the fuel supply due to a mechanical trouble in a stopping mechanism.

In the prior art stopping devices as described, the drive of the engine stop actuator is controlled by detecting the rotation of the engine. It becomes difficult in such an arrangement to adequately drive the engine stopping actuator if the rotation detection signal of the engine stops due to disconnection of the signal line.

SUMMARY OF THE INVENTION

An object of the present invention is to provide a diesel engine stopping device which will properly control an engine stopping operation even if an engine rotation signal becomes absent due to disconnection of the signal line in an engine stopping operation, and which will prevent an engine stop actuator from being burnt even if the engine does not stop due to a malfunction of a stopping mechanism.

A diesel engine stopping device according to the present invention comprises an engine rotation detection section for detecting a rotation of the engine to output a rotation detection signal; an engine stopping operation section for operating an engine stopping actuator to be driven in a setting time for stopping of the engine when a key switch is brought from an ON state into an OFF state; and an engine stopping release section for releasing the engine stopping actuator in the engine stopping operation section from its drive when the rotation detection signal becomes absent after reception of the rotation detection signal from the engine rotation detection section.

In the stopping device of the diesel engine according to the present invention, when the key switch is turned from an ON state to an OFF state, the engine stopping actuator is driven irrespective of existence of the rotation detection signal. When the engine stops so as to nullify the rotation detection signal which has been input, the engine stopping actuator is released from its drive within the setting time. Even if the rotation detection signal of the engine cannot be obtained due to disconnection of the signal line, or, even if the engine does not stop within the setting time due to a mechanical trouble in a stopping mechanism, the drive of the engine stopping actuator is finished after expiration of the setting time.

DESCRIPTION OF THE PREFERRED EMBODIMENTS

Preferred embodiments according to the present invention are described below with reference to the accompanying drawings.

First Embodiment

Figure 1:
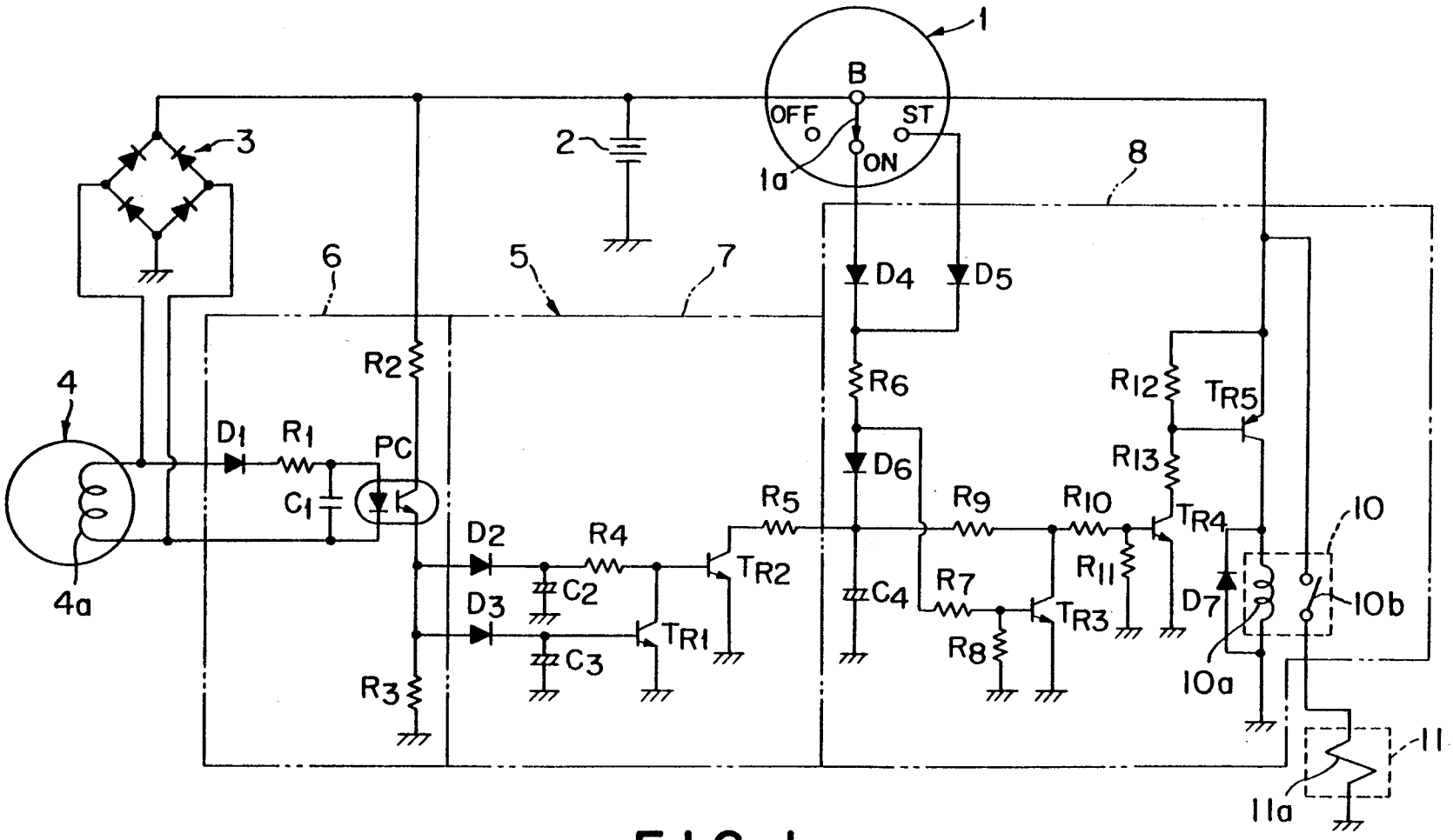
FIG. 1 is a circuit diagram of an engine stopping device according to the present invention.

In FIG. 1, numeral 1 denotes a key switch, which has an OFF terminal, an ON terminal, and an ST (starter) terminal. Further, the key switch 1 has a B terminal with a movable contact 1*a* selectively connectable with each of the other terminals. The B terminal is connected to a battery 2, and through a rectifier 3 (full-wave rectifier of diode bridge) to a charge coil 4*a* of a generator 4.

An output terminal of the charge coil 4*a* is connected to an engine stopping device 5, which is provided with an engine rotation detection section 6, an engine stopping release section 7, and an engine stopping operation section 8.

The engine rotation detection section 6 comprises a photo coupler PC and a half-wave rectifier comprised of a diode D1, a resistor R1, and a smoothing capacitor C1. A light emitting diode (LED) of the photo coupler PC is connected through the half-wave rectifier comprised of the diode D1, the resistor R1, and the capacitor C1 to an output terminal of the charge coil 4*a*. A collector of a photo transistor provided in the photo coupler PC, is connected through a resistor R2 to the battery 2, and an emitter of the photo transistor is grounded through a resistor R3.

In the engine rotation detection section 6, the charge coil 4*a* is isolated by the photo coupler PC to prevent noises from entering circuits to follow.

In the engine stop release section 7, anodes of diodes D2, D3 are connected to the emitter of the photo transistor. A cathode of the one diode D2 is connected to a capacitor C2, and a base of an npn transistor TR2 through a resistor R4. A cathode of the other diode D3 is connected to a capacitor C3 and a base of an npn transistor TR1.

Emitters of the transistors TR1, TR2 are both grounded. A collector of the transistor TR1 is connected to the base of the transistor TR2, and a collector of the transistor TR2 is connected to one end of a resistor R5.

In the engine stop operation section 8, anodes of each of diodes D4, D5 are connected to the ON terminal and the ST terminal of the key switch 1, respectively, and cathodes of the diodes D4, D5 are connected to each other and then to one end of a resistor R6.

Another end of the resistor R6 are connected to an anode of a diode D6 and a base of an npn transistor TR3 through a resistor R7. A bias resistor R8 is grounded at one end and is connected to the base of the transistor TR3 at the other end.

A cathode of the diode D6 are connected to the other end of the resistor R5 in the engine stopping release section 7, and a capacitor C4. The capacitor C4 are connected to a base of an npn transistor TR4 through resistors R9, R10, and further connected to a collector of the transistor TR3 at a junction of the resistors R9, R10.

The transistor TR4 is connected at the base to one end of a bias resistor R11 grounded at another end thereof, and at a collector through a resistor R13 to the base of a pnp transistor TR5 and through a resistor R12 to the B terminal of the key switch 1.

The transistor TR5 is connected at an emitter to the B terminal of the key switch 1 and at the collector to an exiting coil 10*a* of a relay switch 10 in parallel with a surge absorbing diode D7.

The relay switch 10 is connected at one end of a relay contact 10*b* to the B terminal of the key switch 1 to receive a supply of power VCC, and at the other end of relay contact 10*b* to an exciting coil 11*a* of a solenoid 11, which is an engine stopping actuator.

Figure 2:
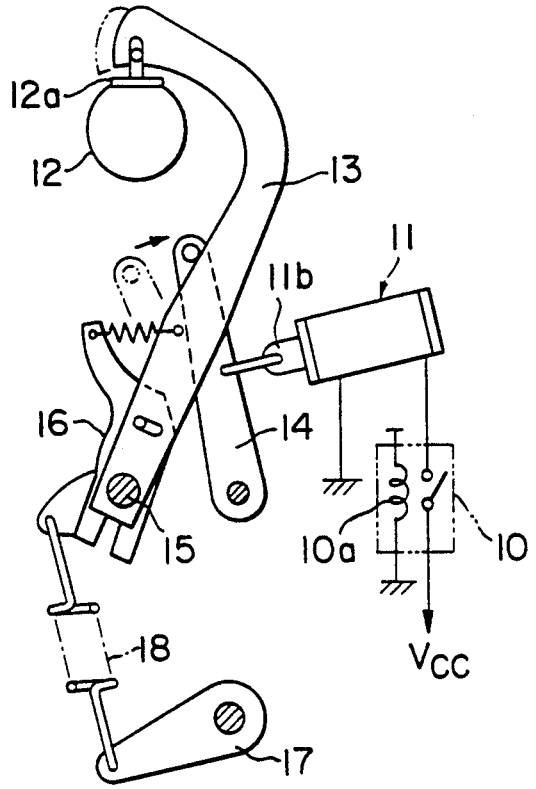
FIG. 2 is a schematic drawing of a governor apparatus.

The solenoid 11 is connected with an adjustment mechanism to adjust the fuel supply. The adjustment mechanism also serves as a stopping mechanism to shut off the fuel supply to the engine. In detail, as shown in FIG. 2, a governor lever 13 is engaged with a control rack 12*a* to set the injection amount of a fuel injection pump 12. A stopping lever 14 is connected to the governor lever 13 to force the governor lever 13 to rotate toward a stopping position as shown by a solid line. A plunger 11*b* of the solenoid 11 is connected to the stop lever 14.

The plunger 11*b* of the solenoid is projected out during an ordinary operation, so that the stopping lever 14 is separated from the governor lever 13 as shown by a phantom line in FIG. 2.

The governor lever 13 is connected on a governor shaft 15, which is provided with a governor weight (not shown) urging the governor shaft 15 toward a low speed side (in the clockwise direction in FIG. 2) with a centrifugal force upon engine rotation. A control link 16 is mounted on the governor lever 13 and is connected through a governor spring 18 to a control lever 17.

The operation of the stopping device thus structured is as follows.

When the engine is to be started, the movable contact 1*a* of the B terminal of the key switch 1 is turned from the OFF terminal to the ON terminal. Thus, in the engine stopping device 5, an electric current flows from the battery 2 through the diode D4 and the resistor R6 in the engine stopping operation section 8. It flows further through the diode D6 to charge the capacitor C4 and through the resistor R7 and the bias resistor R8 to the base of the transistor TR3 with a base current flowing.

Consequently, the transistor TR3 is turned on, whereby the base voltage of the transistor TR4 becomes approximately that of ground level, turning off the transistor TR4. In this turn causes, the next transistor TR5 is turned off so as to turn off the relay switch 10, keeping the solenoid 11 in a non-operating state.

Then, the movable contact 1*a* of the B terminal of the key switch 1 is connected to the ST terminal to start a starter (not shown). Once the engine starts, the movable contact 1*a* is returned to the ON terminal. After the engine starts, an alternating voltage is generated in the charge coil 4*a* of the generator 4, which is subject to full-wave rectification in the rectifier 3 to charge the battery 2.

The output of the charge coil 4*a* of the magneto 4 is also input into the engine stopping device 5, in which the input signal is subject to half-wave rectification in the diode D1 of the engine rotation detection section 6, and in which the thus-rectified signal is input through the resistor R1 and the smoothing capacitor C1 to the photo coupler PC. In the photo coupler PC, the electric current flowing through the light emitting diode from the charge coil 4*a* is converted into an optical output, by which the photo transistor is turned on.

Then a base current flows from the battery 2 through the resistor R2, the photo transistor of the photo coupler PC, and the diode D3 of the engine stopping release section 7 to the base of the transistor TR1, turning on the transistor TR1. The next transistor TR2 is thereby turned off, so that the engine stopping release section 7 does not operate on the engine stopping operation section 8 to keep the solenoid 11 in the non-operating state.

During an ordinary operation, the control rack 12*a* of the fuel injection pump 12 is moved with a balance between the governor spring 18 and the governor weight (not shown) imparting to the governor shaft 15 a centrifugal force due to engine rotation. Thus the rotational speed of the engine is controlled at a constant value.

Next, the contact 1*a* of the key switch 1 is turned from the ON terminal to the OFF terminal in order to stop the engine, whereby the base current to the transistor TR3 in the engine stop operation section 8 is cut off to turn off the transistor TR3. Then the capacitor C4 starts discharging to turn on the transistor TR4 and thus to turn on the next transistor TR5. A current is supplied from the battery 2 to the exciting coil 10*a* of the relay switch 10 to turn on the relay contact 10*b*. The current from the battery 2 is thereby supplied to the exciting coil 11*a* of the solenoid 11.

The plunger 11*b* of the solenoid 11 thus pulls the stop lever 14 clockwise in FIG. 2 to force the governor lever 13 to rotate in the stopping direction (clockwise in FIG. 2). The control rack 12*a* of the fuel injection pump 12 connected to the governor lever 13 is thereby operated to shut off the fuel supply.

Once the shutting off of the fuel supply stops the engine completely, no output is provided by the charge coil 4*a*. Then the photo transistor of the photo coupler PC is turned off in the engine rotation detection section 6, and the transistor TR1 is also turned off in the engine stopping release section 7. A charge in the capacitor C2 is thereby discharged through the resistor R4 and the base of the transistor TR2 in the engine stopping release section 7 to turn on the transistor TR2. A charge in the capacitor C4 is thereby discharged through the resistor R5 in the engine stopping operation section 8.

By the discharge of the capacitor C4, the transistor TR4, which has been kept on, is turned off before expiration of the setting time, which is equivalent to a time constant $T_{SET}$ determined by the capacitor C4, and the resistors R9, R10. Then, the transistor TR5 and the relay switch 10 are turned off to stop the supply of current to the exciting coil 11*a* of the solenoid 11, returning the solenoid 11 to the initial position. Since the operation of the solenoid 11 is released immediately after the engine has completely stopped, there is no waste consumption of power. Thus the load on the battery 2 is reduced.

For example, if a signal line is disconnected between the charge coil 4*a* and the engine rotation detection section 6 of the engine stopping device 5, a signal will not be input into the engine rotation detection section 6 during the operation of the engine in spite of the fact that the engine is still rotating. Therefore the engine rotation detection section 6 and the engine stopping release section 7 become isolated in the circuit in the engine stopping device 5, because the photo transistor of the photo coupler PC is turned off to keep the transistors TR1, TR2 off.

In this state, when the key switch 1 is turned from the ON state to the OFF state, the transistor TR4 is kept on for the setting time equivalent to the time constant $T_{SET}$ determined by the capacitor C4 and the resistors R9, R10 in the engine stopping operation section 8. At the expiration of the setting time, the capacitor C4 is discharged out to automatically turn off the transistor TR4 and then to turn off the transistor TR5 and the relay switch 10. Thus the solenoid 11 is returned to the initial position.

Thus, even if mechanical trouble in the adjustment mechanism (stopping mechanism) connected to the plunger 11*b* of the solenoid 11 maintains the engine operating without cut-off of fuel supply from the fuel injection pump 12 after a change of the key switch 1 from the ON state to the OFF state, the solenoid 11 will be prevented from being burnt with continuous current flow. The engine can be stopped by manually shutting off the fuel supply.

Second Embodiment

Figure 3:
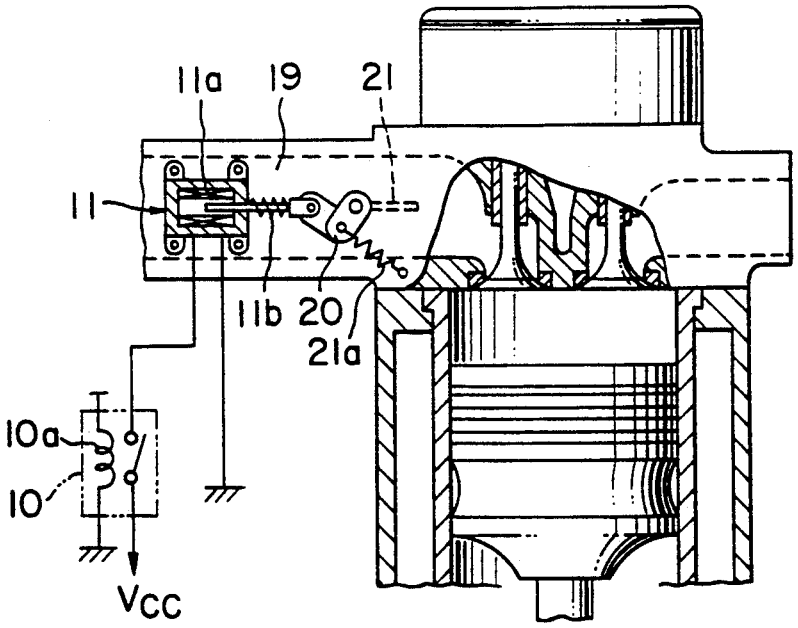
FIG. 3 is a front view showing an essential part of an engine stopping actuator provided in an intake air system and constituting a second embodiment according to the present invention, the stopping actuator being in its non-operating state.
Figure 4:
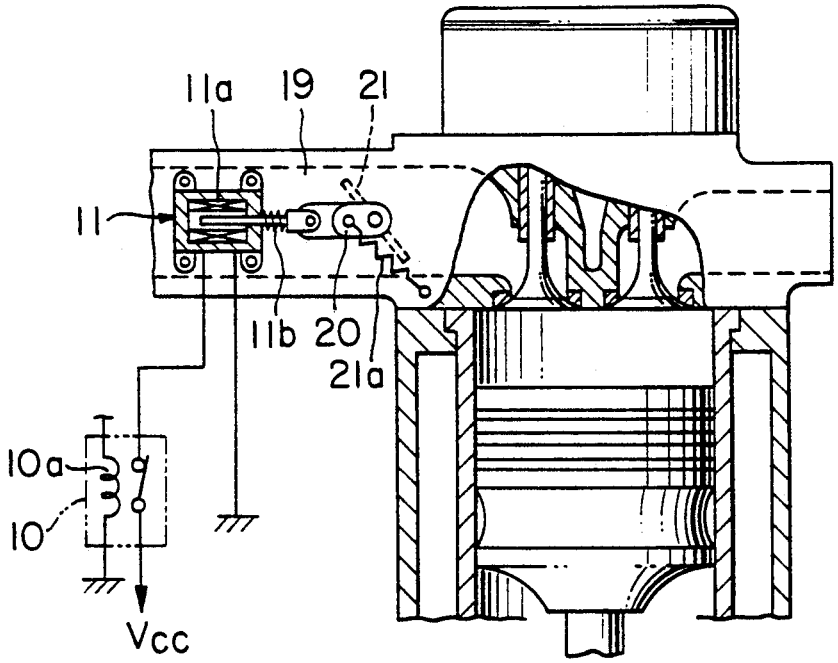
FIG. 4 is a front view similar to FIG. 3 showing the engine stop actuator in its operating state.

The second embodiment according to the present invention is described below with reference to FIGS. 3 and 4. FIGS. 3 and 4 are front views to show two operational states of an engine stopping actuator mounted in an air intake system.

In the second embodiment, the engine is stopped by limiting intake air. The engine stopping device 5 of the first embodiment as described above is also employed.

When the contact 1*a* of the key switch 1 is turned from the ON terminal to the OFF terminal, the engine stopping device 5 operates to turn on the relay switch 10. An electric current then flows through the exciting coil 11*a* of the solenoid 11 mounted on an outside wall of an intake pipe 19.

Then, the plunger 11*b* of the solenoid 11 retracts to close an intake valve 21 disposed in the intake pipe 19 through a link 20, thereby limiting the air intake to stop the engine (state of FIG. 4). When the relay switch 10 is turned off, the intake valve 21 is again opened by the biasing force of a return spring 21*a* (state of FIG. 3).

The present invention is not limited to the above described embodiments thereof. For example, the diesel engine to be applied may be an industrial engine as well as an engine mounted on an automobile. The engine stopping actuator is not restricted only a solenoid but can also be a hydraulic actuator. Further, in the first embodiment, the engine stopping actuator may be adapted to directly urge the control rack 12*a* of the fuel injection pump 12 toward the stopping side.

According to the present invention as described, when the key switch is turned from the ON state to the OFF state, the engine stopping actuator is driven in the setting time irrespective of existence of the rotation detection signal. Then, if the rotation detection signal stops because the engine stops, the engine stopping actuator is released from drive in the setting time, avoiding waste consumption of power. Even if the rotation detection signal of the engine cannot be transmitted due to disconnection of signal line, or, even if the engine does not stop within the setting time due to mechanical trouble in the stopping mechanism, the engine stopping actuator will never continue to operate after expiration of the setting time. Thus burning of the actuator in a long term drive is prevented.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A device for stopping a diesel engine having an engine stopping actuator for stopping the diesel engine the device comprising:

an engine rotation detection section for detecting the rotation of the engine to output a rotation detection signal;

an engine stopping operation section for operating the engine stopping actuator; and an engine stopping release section for releasing the engine stopping operation section to stop the actuator when the rotation detection signal terminates after the reception of the rotation detection signal from said engine rotation detection section ceases, wherein said engine stopping operation section has starting means for starting the operation of the engine stopping actuator when a key switch is brought from an ON state to an OFF state, and releasing means for releasing the operation of the engine stopping actuator when a set period elapses so as to avoid keeping the engine stopping actuator in an ON state over set period.

2. The device for stopping the diesel engine according to claim 1, wherein said engine stopping actuator is connected with an adjustment mechanism to adjust the fuel supply; and said engine stopping actuator shuts off the fuel supply to the engine when driven.

3. The device for stopping the diesel engine according to claim 2, wherein said engine stopping actuator comprises a solenoid.

4. The device for stopping the diesel engine according to claim 1, wherein said engine stopping actuator is connected with a stop valve in the engine air intake pipe; and said engine stop actuator closes said valve to limit intake air when driven.

5. The device for stopping the diesel engine according to claim 1, wherein said set period is determined by the combination of the elements constituting said engine stopping operation section.

6. The device for stopping the diesel engine according to claim 1, wherein said engine rotation detection section comprises a photo coupler, said photo coupler outputting an engine rotation detection signal while the engine rotates and stopping the output of the signal when the engine stops.

* * * * *